United States Patent [19]

Strautz

[11] 4,192,571

[45] Mar. 11, 1980

[54] ELECTRICAL CONNECTOR STRAIN RELIEF HOUSING

[75] Inventor: Michael G. Strautz, Columbus, Ohio

[73] Assignee: Bell Telephone Laboratories, Incorporated, Murray Hill, N.J.

[21] Appl. No.: 949,448

[22] Filed: Oct. 10, 1978

[51] Int. Cl.[2] ..... H01R 13/58

[52] U.S. Cl. ..... 339/103 M; 339/76

[58] Field of Search ..... 339/103 C, 103 M, 103 R, 339/107, 75 M, 75 MP, 76

[56] References Cited

U.S. PATENT DOCUMENTS

| | | | |
|---|---|---|---|
| 3,056,942 | 10/1962 | Carbaugh et al. | 339/103 M X |
| 3,090,028 | 5/1963 | Hall et al. | 339/107 X |
| 3,864,011 | 2/1975 | Huber | 339/103 M |
| 4,080,038 | 3/1978 | Latta et al. | 339/103 M |

*Primary Examiner*—Roy Lake
*Assistant Examiner*—DeWalden W. Jones
*Attorney, Agent, or Firm*—William H. Kamstra; Jerry W. Herndon

[57] ABSTRACT

A strain relief housing for a flat ribbon cable (11) terminating in an electrical connector (10) in which the housing comprises a pair of identical halves (20, 30) each having a flange (27) extending outwardly therefrom for clasping the cable (11) therebetween. Each flange (27) has extending outwardly therefrom at opposite ends a lug (28) and a notch (29), the lug (28) of one flange (27) being adapted to fold into the notch (29) of and about the other flange (27) to pierce a margin (13) at each side of the cable (11).

6 Claims, 2 Drawing Figures

ELECTRICAL CONNECTOR STRAIN RELIEF HOUSING

TECHNICAL FIELD

This invention relates to electrical connector assemblies for flat ribbon cables and particularly to associated apparatus for providing strain relief for such cables.

BACKGROUND ART

The necessity for providing strain relief for electrical cables of whatever cross-section is well known in the art as are numerous arrangements for providing that relief. Were no means for restraining the conductors of a cable provided at their point of connection with associated terminals or electrical equipment, the soldered or other conductor terminations would be constantly vulnerable to interruption by stresses applied to the cable. To safeguard against such separation of cable conductors from their component terminals, a number of strain relief devices have been provided, ranging from a simple clamp for fixedly holding the cable relative to its terminating component to more complex arrangements such as that disclosed, for example, in U.S. Pat. No. 4,080,038 of J. C. Latla et al., issued Mar. 21, 1978. The strain relief arrangement there shown comprises a pair of elongated members arranged on each side of a flat ribbon cable connector which are snapped inwardly to urge and hold the cable conductors in contact with the connector contacts. This arrangement, although effective to restrain the conductors and to provide relief against external stress, is manifestly complex and by adding a number of moving parts, adds substantially to the cost of the connector assembly. From the latter viewpoints alone, a simple clamping arrangement in which opposing flanges clamp the ribbon cable therebetween presents significant advantages.

For the most part such simple clamping arrangements have in the past adequately performed their strain relief function. By exerting clamping pressure on each side of a ribbon cable, the cable is effectively prevented from any outward movement, thereby, in turn, preventing stress on the conductor terminations. This very pressure, however, although restraining the conductors, has in the past caused problems and, on occasion, caused a shorting of conductors with the clamping means. The plastic ribbon material in which the conductors are embedded, typically, polyethelene-terephthalate, is subject to pressure caused cold flow. As a result, either during assembly or after installation, a high risk is presented that the clamping pressure will cause an extrusion of the plastic cable insulation from a conductor or conductors with a concomitant shorting of the conductors with the clamp. It is to this problem, together with the objective of simplifying its manufacture, that the strain relief apparatus of this invention is directed.

SUMMARY OF THE INVENTION

One illustrative strain relief apparatus according to this invention comprises an electrical connector housing formed of two identical halves, each stamped from a metallic blank and then, by means of a number of 90-degree folds, is shaped to present an open-sided, rectangular envelope for one-half of a ribbon connector along its longitudinal axis. More specifically, each housing half is folded to present a side wall and two end walls to encase one side and the complete ends of the connector. The stamped half is then again folded downwardly from the side wall sufficiently to cover approximately one-half of the connector top from which the ribbon cable emerges. Another fold raises a flange along the housing half top extending upwardly, which flange will ultimately serve as one half of the clamp for the ribbon cable. One end of the flange is provided with a rectangular notch, the opposite end, with an outwardly extending lug dimensioned to fit a similar notch. Final folds of the blank result in a pair of apertured mounting lugs extending outwardly from the base of the end walls, which lugs correspond to the mounting lugs of the ribbon connector with which the strain relief apparatus of the invention is to be associated.

The connector housing and connector are simply assembled by taking two of the housing halves described in the foregoing, reversing one to present opposing open sides so that the flange lug of one is opposite the flange notch of the other. The two halves are then fitted about the connector so that the full ends of each and their oppositely extending mounting lugs overlap to align the mounting apertures with the corresponding apertures of the connector mounting lugs. As thus fitted, the two upwardly extending flanges of the halves will bear firmly, but without undue pressure, on the opposite sides of the ribbon cable extending upwardly from the connector top. At this point, or after both housing and connector have been mounted on a supporting surface, the flange lug of each housing half is folded 180 degrees into the notch of the other to bear firmly against the reverse surface of the opposite flange. As the flange lugs are thus folded, the outer edges of the ribbon cable held therebetween are sheared or notched, the lugs thus fitted securely in the cable edge notches effectively preventing any outward withdrawal of the cable conductors from the enclosed connector. The housing halves are dimensioned with respect to the connector so that only a mild pressure is applied by the opposite flanges on the cable sides. As a result, without sufficient clamping pressure, cold flow of the cable insulation is not occasioned.

BRIEF DESCRIPTION OF THE DRAWING

The features and advantages of a strain relief apparatus according to the principles of this invention will be better understood from a consideration of the detailed description of the organization and assembly of one illustrative embodiment thereof which follows when taken in conjunction with the accompanying drawing in which.

DETAILED DESCRIPTION

Figure 1:
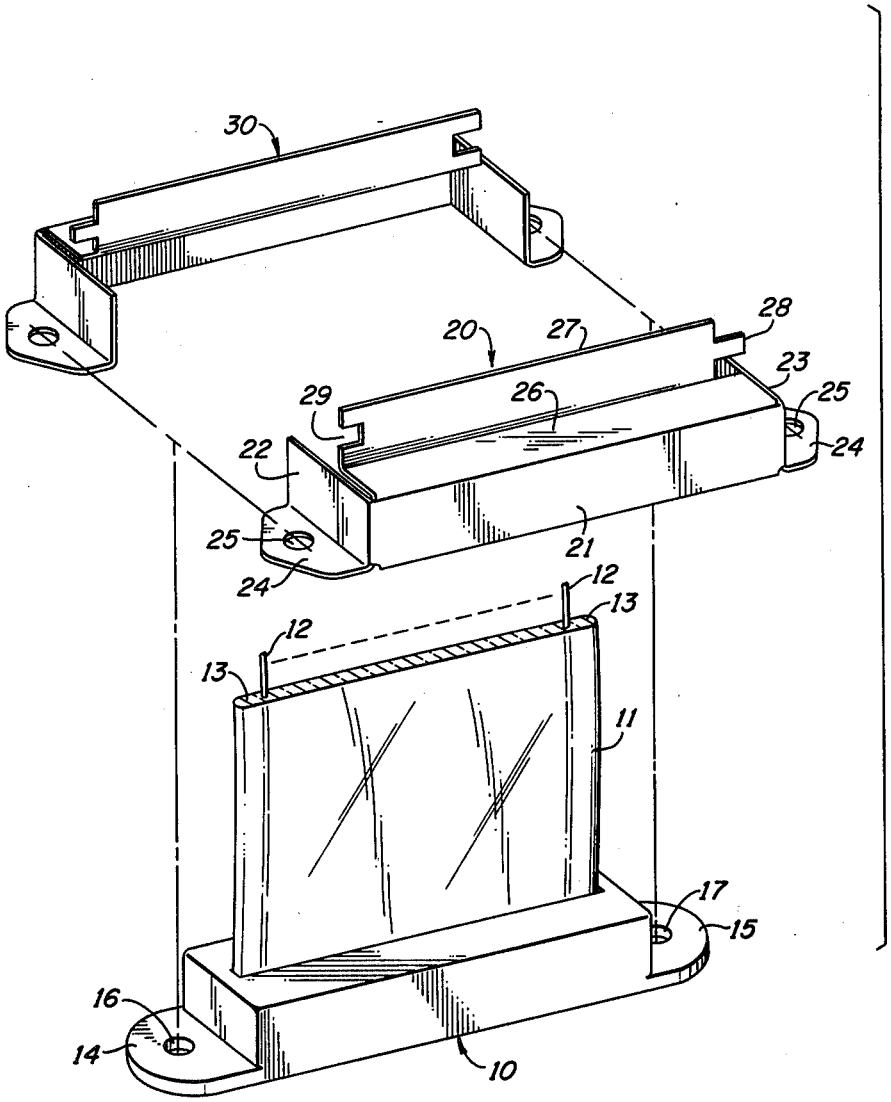
FIG. 1 is an exploded, perspective view of the elements of a connector assembly showing the details of the two halves of a strain relief housing according to this invention.

The elements of a strain relief housing according to this invention are shown in exploded view in FIG. 1 in association with a conventional electrical ribbon cable connector 10 and its cable 11. Cable 11 is formed of any suitable electrically insulative plastic material such as, for example, polyethelene-terephthalate, having a plurality of electrical conductors 12 imbedded therein. Conductors 12 of cable 11 normally begin and end across the width of cable 11 to leave a small margin 13 at each edge of the cable. Conductors 12 terminate within the body of connector 10 by interconnections to respective terminals not visible in the figure. Connector 10 is also provided with conventional terminal sockets, also not visible in the figure, at its underside to admit terminal pins of subsequent electrical interconnections. Connector 10 has extending from opposite ends a pair of mounting lugs 14 and 15 having respective apertures 16 and 17 for mounting to a panel or like flat surface. The substantially rectangular body of connector 10 is contemplated in the assembly as being enclosed by the strain relief housing of the invention which may now be described.

As depicted in FIG. 1, the strain relief housing comprises a pair of identical halves 20 and 30 shown in the figure in positions preparatory to their fitting about the body of connector 10. Each of the housing halves 20 and 30 is stamped or otherwise formed from a metallic blank and by a series of 90-degree folds is shaped into its ultimate half-box-like form. The blank may be first folded outwardly (as viewed in the drawing with respect to housing half 20) to present a side wall 21 and a pair of end walls 22 and 23, each wall being loosely dimensioned to fit about the side and end walls of connector body 10. Second 90-degree folds result in a pair of mounting lugs 24 extending outwardly from end walls 22 and 23, respectively, each having an aperture 25 therein. Next, a 90-degree fold from side wall 21 forms a top wall 26 extending between the upper edges of end walls 22 and 23. In a final 90-degree fold, top wall 26 is turned upwardly to present a flange 27 extending between slightly less than the midpoints of the top edges of end walls 22 and 23. Phrased differently, top wall 26 is dimensioned to cover that area of connector 10 top lying between one side of cable 11 and the connector body top edge. Flange 27 has formed at one end thereof an outwardly extending lug 28 lying substantially at the midpoint of the flange edge. At the opposite end of flange 27 is formed a rectangular notch 29 also at substantially the midpoint of the flange edge, notch 29 being dimensioned to admit a lug of the dimensions of lug 28. The distance between the end of lug 28 and the opposite notched edge of flange 27 is approximately equal to the width of ribbon cable 11 for reasons which will appear hereinafter. Although in the foregoing a particular sequence of folding operations was described, that sequence was illustrative only and it will be appreciated that any convenient folding sequence may be employed. Indeed, it is contemplated that, in practice, the housing halves may be mass produced in one simultaneous stamping and folding operation. Since housing half 30 is identical to half 20, its details need not be repeated.

Figure 2:
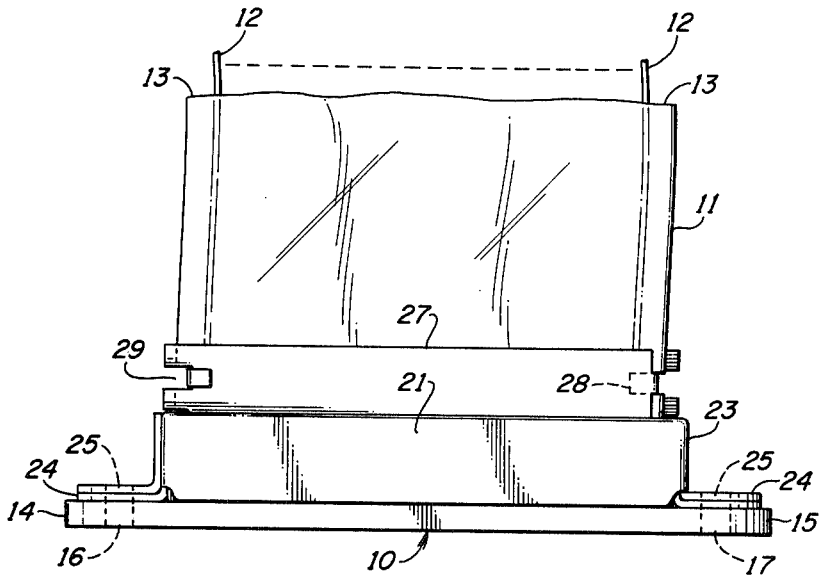
FIG. 2 is a side elevation of the assembled elements of FIG. 1 showing the manner in which the flange lugs of the housing halves restrain an electrical ribbon cable.

As is apparent from the arrangements of elements in FIG. 1, during assembly, housing half 30 assumes a position reverse to that of half 20 so that the flange lug 28 of one is opposite the notch 29 of the other. In these positions, halves 20 and 30 are fitted about the body of connector 10 on opposite sides of ribbon cable 11. The halves 20 and 30 are fitted together as also shown in FIG. 2, so that one end wall of one overlaps at one end the end wall of the other, the opposite end wall of the other overlapping at the other end the opposite end wall of the first. In this fitted-together assembly, the mounting lugs and apertures of each housing half are thus in alignment with the corresponding members and apertures of connector 10. The dimensions of halves 20 and 30 are determined so that, as thus fitted together, flanges 27 of each half bear with slight force on opposite sides of ribbon cable 11.

In a final step in the assembly and as shown in FIG. 2, the flange lug of each housing half 20 and 30 is folded over 180 degrees into the flange notch of the other, breaking through the margin 13 at either side of cable 11. Each of the flange lugs is firmly crimped to clamp a portion of the margin 13 between it and the surface of the opposite flange thereby providing firm and positive restraint on each side of cable 11 to its inadvertent withdrawal from connector 10 without undue pressure on the imbedded conductors. Manifestly, an even greater measure of restraint may be achieved by also folding over the two lugs formed at the notched end of the flange of a housing half to clamp additional portions of the cable margin 13 between those lugs and a flange surface.

What has been described is considered to be only one illustrative strain relief housing arrangement according to the principles of this invention and it is to be understood that various and numerous other arrangements may be devised by one skilled in the art without departing from the spirit and scope of the invention as limited only as defined in the accompanying claims.

I claim:

1. Strain relief apparatus for a flat ribbon cable (11) terminating in an electrical connector (10) characterized in a housing (20, 30) for partially enclosing said connector (10), said housing (20, 30) having a pair of flanges (27) extending outwardly from said connector (10) for clasping opposite sides of said cable (11), further characterized in an outwardly extending lug (28) on one end of one flange (27) and a notch (29) on the corresponding end of the other flange (27), said lug (28) being adapted to fold into said notch (29) thereby piercing a margin (13) of said cable (11).

2. Strain relief apparatus for a flat ribbon cable (11) terminating in an electrical connector (10) CHARACTERIZED IN a housing (20, 30) for partially enclosing said connector (10), said housing (20, 30) having a pair of flanges (27) extending outwardly from said connector (10) for clasping opposite sides of said cable (11), further characterized in a first outwardly extending lug (28) on one end of a first one of said flanges and a first notch (29) on the opposite end of said first flange, a second lug on a second one of said flanges, located at an end thereof corresponding to the first notch, and a second notch located at the remaining end of said second flange, said lugs (28) being adapted for folding into said notches (29) thereby piercing margins (13) at each side of said cable (11).

3. Strain relief apparatus according to claim 1 or 2 further characterized in that said housing comprises a pair of separate, identical halves (20, 30) adapted to be fitted together over opposite sides of said connector (10).

4. A strain relief housing for a flat ribbon cable (11) terminating connector (10) characterized in that said housing comprises a pair of separate, identical halves (20, 30) adapted to be fitted together over opposite sides of said connector, each housing half (20, 30) having a flange (27) extending outwardly from said connector (10), and further characterized in that each of said flanges (27) is provided at one end with an outwardly extending lug (28) and at the opposite end with a notch (29), the lugs (28) of each flange (27) being adapted to fold into the notch (29) of and about the other flange

(27) to pierce at each end a margin (13) of a cable (11) when clasped between said flanges (27).

5. A strain relief housing (20) for partially enclosing an electrical cable (11) terminating connector (10) characterized in that said housing (20) comprises a side wall (21), a pair of end walls (22, 23), a top wall (26), for partially covering the face of said connector (10), and a flange (27) extending outwardly from said top wall (26), further characterized in a lug (28) extending outwardly from one end of said flange (27) and a notch (29) provided at the opposite end of said flange (27), said housing (20) being adapted to be fitted together with an identical housing (30) to complete enclosure of said connector (10), the lug (28) of one housing (20) being adapted to fold into the notch (29) of the other housing (30) to pierce the margins (13) of a cable (11) when clasped between said flanges (27).

6. Strain relief apparatus for restraining a flat ribbon electrical cable terminating in an electrical connector, said apparatus comprising a pair of flanges associated with said connector for clasping said cable therebetween, said flanges each having an outwardly extending lug and a notch at opposite ends of said cable, said lug of one flange being adapted to fold into the notch of and about the other flange to pierce at each side the margin of said cable.

* * * * *